US008851161B2

(12) United States Patent
Scott et al.

(10) Patent No.: US 8,851,161 B2
(45) Date of Patent: Oct. 7, 2014

(54) CROSS-COMMUNICATION BETWEEN ELECTRONIC CIRCUITS AND ELECTRICAL DEVICES IN WELL TOOLS

(71) Applicant: Halliburton Energy Serivecs, Inc., Houston, TX (US)

(72) Inventors: Bruce E. Scott, McKinney, TX (US); John J. Goiffon, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/085,349

(22) Filed: Nov. 20, 2013

(65) Prior Publication Data

US 2014/0202711 A1 Jul. 24, 2014

Related U.S. Application Data

(63) Continuation of application No. PCT/US2013/022499, filed on Jan. 22, 2013.

(51) Int. Cl.
*E21B 34/16* (2006.01)
*E21B 41/00* (2006.01)

(52) U.S. Cl.
CPC ..... *E21B 41/00* (2013.01)
USPC ..... 166/65.1; 166/66.6; 166/66

(58) Field of Classification Search
CPC ..... E21B 34/066
USPC ..... 166/65.1, 66, 66.6
See application file for complete search history.

(56) References Cited

U.S. PATENT DOCUMENTS

| | | | | |
|---|---|---|---|---|
| 4,138,669 | A * | 2/1979 | Edison et al. | 340/3.51 |
| 5,469,442 | A * | 11/1995 | Seligmann et al. | 340/870.04 |
| 5,547,029 | A | 8/1996 | Rubbo et al. | |
| 5,801,913 | A | 9/1998 | Pittel | |
| 5,995,020 | A | 11/1999 | Owens et al. | |
| 6,003,601 | A | 12/1999 | Longbottom | |
| 6,046,685 | A | 4/2000 | Tubel | |
| 6,104,645 | A | 8/2000 | Ong et al. | |
| 6,247,536 | B1 * | 6/2001 | Leismer et al. | 166/305.1 |
| 6,310,829 | B1 * | 10/2001 | Green et al. | 367/82 |

(Continued)

OTHER PUBLICATIONS

Meyer, Darrin, "Definition of Cable Splitters", web page, retrieved Dec. 12, 2013 from http://www.ehow.com/about_5057477_definition-cable-splitters.html, 3 pages.

(Continued)

*Primary Examiner* — Kenneth L Thompson
(74) *Attorney, Agent, or Firm* — Smith IP Services, P.C.

(57) ABSTRACT

A well tool can include multiple electrical devices and multiple electronic circuits which control operation of the respective electrical devices, each electronic circuit including a respective isolation circuit, wherein each of the isolation circuits isolates a corresponding one of the electronic circuits from a respective one of the electrical devices in response to a predetermined condition. A method of operating a well tool can include providing multiple electronic circuits for operation of respective multiple electrical devices of the well tool, disconnecting one electronic circuit from its respective electrical device in the well, and connecting another electronic circuit to the electrical device in the well. Another method of operating a well tool can include providing multiple electronic circuits for operation of respective multiple electrical devices of the well tool, disconnecting one electronic circuit from its respective electrical device in the well, and connecting the electronic circuit to another electrical device.

27 Claims, 4 Drawing Sheets

(56) References Cited

U.S. PATENT DOCUMENTS

| | | | | |
|---|---|---|---|---|
| 6,420,976 | B1 * | 7/2002 | Baggs et al. | 340/853.3 |
| 6,816,082 | B1 | 11/2004 | Laborde | |
| 6,920,085 | B2 | 7/2005 | Finke et al. | |
| 7,000,693 | B2 * | 2/2006 | Powell | 166/66.4 |
| 7,009,312 | B2 * | 3/2006 | Hernandez-Marti et al. | 307/34 |
| 7,148,812 | B2 * | 12/2006 | Baggs | 340/853.7 |
| 7,520,321 | B2 * | 4/2009 | Hiron et al. | 166/65.1 |
| 7,931,090 | B2 * | 4/2011 | Smedstad et al. | 166/366 |
| 2003/0213595 | A1 | 11/2003 | Jackson | |
| 2006/0033637 | A1 * | 2/2006 | Hall et al. | 340/853.1 |
| 2011/0176584 | A1 | 7/2011 | Kikuchi et al. | |

OTHER PUBLICATIONS

Screen Subtitling Systems LTD, "Polistream Redundancy Strategies", article, Jul. 2011, 8 pages.

Texas Instruments Inc., "Quad SPDT Wide-Bandwidth Video Switch With Low On-State Resistance", TS3V330, product information catalog, Jul. 2005, 27 pages.

Search Report and Written Opinion issued Oct. 15, 2013 for International Application No. PCT/US13/22499, 10 pages.

* cited by examiner

CROSS-COMMUNICATION BETWEEN ELECTRONIC CIRCUITS AND ELECTRICAL DEVICES IN WELL TOOLS

CROSS-REFERENCE TO RELATED APPLICATION

This application is a continuation under 35 USC 120 of International Application No. PCT/US13/22499, filed on 22 Jan. 2013. The entire disclosure of this prior application is incorporated herein by this reference.

BACKGROUND

This disclosure relates generally to equipment utilized and operations performed in conjunction with a subterranean well and, in one example described below, more particularly provides for increased reliability through redundancy in well tools.

Subterranean wells are hostile environments for electrical components. Failure of an electrical component can cost many hours and much expense to remedy. Therefore, it will be appreciated that improvements are continually needed in the art of utilizing electrical components in well tools.

DETAILED DESCRIPTION

Figure 1:
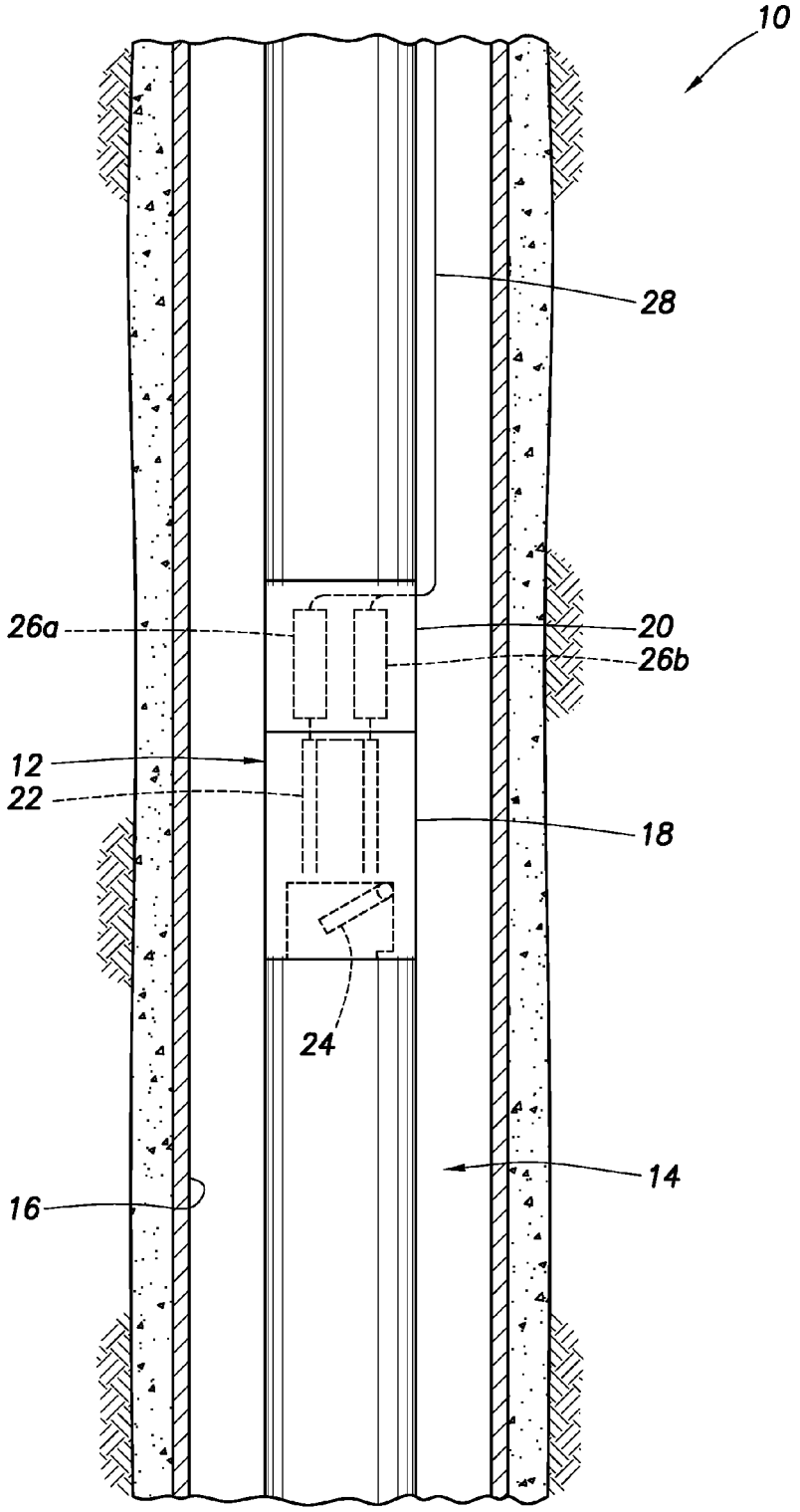
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well tool 12 is connected in a tubular string 14 positioned in a wellbore 16. In the depicted example, the well tool 12 is of the type known to those skilled in the art as a safety valve 18 with a remotely controlled actuator section 20 for actuating the valve to its open and closed configurations, in which flow through the tubular string 14 is respectively permitted and prevented.

However, the scope of this disclosure is not limited to use only with safety valves. Other types of well tools can also benefit from the principles described herein.

As depicted in FIG. 1, the safety valve 18 includes an opening prong 22, which is displaced downward to pivot a flapper 24 to its open position, in which flow is permitted longitudinally through the safety valve. The opening prong 22 can be displaced upward to allow the flapper 24 to pivot to its closed position, in which at least upward flow is prevented through the safety valve.

The opening prong 22 is displaced by redundant actuators 26*a,b* of the actuator section 20. Although two actuators 26*a,b* are depicted in FIG. 1, any number of actuators may be used, as desired.

The actuators 26*a,b* are redundant, in that either of them may be used to actuate the safety valve 18 by displacing the opening prong 22. A particular actuator 26*a,b* is redundant, in that it can be used to displace the opening prong 22 in the event that another actuator is not available, whether or not the particular actuator was previously used for displacing the opening prong.

In the FIG. 1 example, the actuator section 20 is controlled via lines 28 extending to a remote location (such as, the earth's surface, a subsea location, etc.). In other examples, the actuator section 20 could be controlled via wireless telemetry, or it could be controlled locally. The scope of this disclosure is not limited to any particular well tool control location or means.

Figure 2:
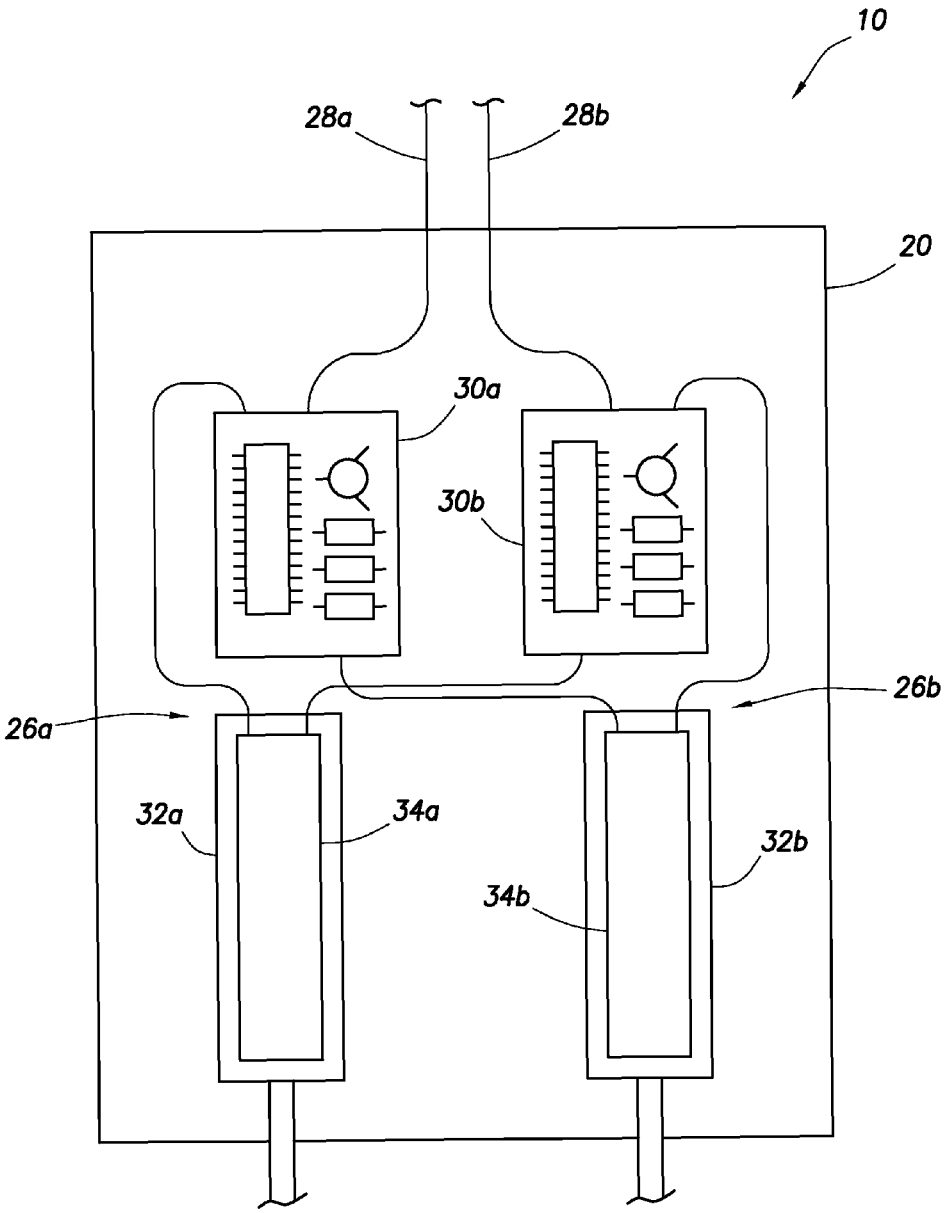
FIG. 2 is a representative schematic view of an actuator section of a well tool.

Referring additionally now to FIG. 2, an example of the actuator section 20 is representatively illustrated, apart from the remainder of the well tool 12. In this example, it may be seen that each of the actuators 26*a,b* includes an electronic circuit 30*a,b* for controlling operation of a respective electrical device 32*a,b*.

The electrical devices 32*a,b* comprise motors in this example, with each motor having an associated motor winding 34*a,b*. However, in other examples the electrical devices 32*a,b* could be other types of electrical devices, such as, electrical brakes, clutches, valves, etc.

In normal operation, electronic circuit 30*a* is used to control operation of the device 32*a*, and electronic circuit 30*b* is used to control operation of device 32*b*. However, the electronic circuit 30*a* can be used to operate the device 34*b*, and the electronic circuit 30*b* can be used to operate the device 32*a*.

Figure 3:
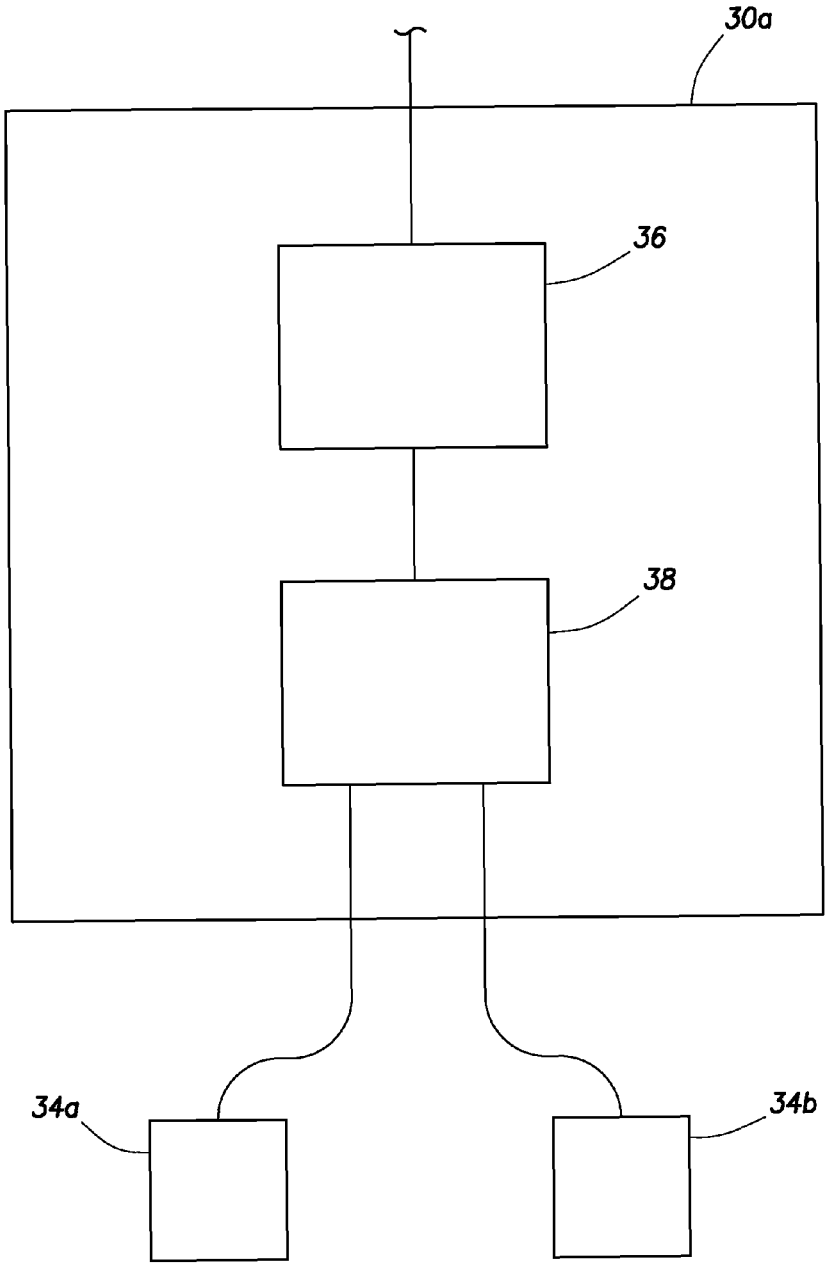
FIG. 3 is a representative schematic view of a circuit diagram for redundantly operating multiple electrical devices via a single downhole electronic control circuit.

Referring additionally now to FIG. 3, the electronic circuit 30*a* is representatively illustrated in schematic form. In this view, it may be seen that the electronic circuit 30*a* includes a driver circuit 36 and an isolation circuit 38. The other electronic circuit 30*b* is preferably similarly configured.

The isolation circuit 38 can isolate the motor windings 34*a,b* (and any other common actuator windings) from the driver circuit 36 if the driver circuit fails. In addition, the isolation circuit 38 can isolate the driver circuit 36 from a failed motor winding 34*a,b*.

The isolation circuit 38 can be triggered by excessive current draw by the respective device 32*a,b*, excessive voltage across the respective device, or in response to a command generated remotely or locally. The isolation circuit 38 can isolate the output of an electronic circuit 30*a,b* from its respective electrical device 32*a,b* or it can isolate only a driver circuit 36 that has failed, for example, a motor driver circuit, etc.

The electronic circuits 30*a,b*, thus, have multiple outputs and the isolation circuits 38 that allow the electronic circuits 30*a,b* to switch electrical power from one output to another as needed. This switching is not necessarily permanent. The switching can be software or hardware driven. Preferably, the switching of the outputs would be initiated by a command from a remote location, and in response the downhole electronic circuits 30*a,b* performing the actual switching.

For example, if the electronic circuit 30*b* fails (e.g., the driver circuit 36 thereof fails), but the electrical device 32*b* can still be used to actuate the well tool 12, the isolation circuit 38 of the electronic circuit 30*b* can disconnect the driver circuit 36 of the electronic circuit 30*b* from the device 32*b*, and the isolation circuit of the electronic circuit 30*a* can connect the driver circuit of the electronic circuit 30*a* to the device 32*b*, so that the electronic circuit 30*a* can be used to operate the device 32*b*. Such a change could be performed automatically in response to the failure of the electronic circuit 30*b*, or in response to a command generated remotely or locally.

Similarly, if the electronic circuit 30*a* fails (e.g., the driver circuit 36 thereof fails), but the electrical device 32*a* can still be used to actuate the well tool 12, the isolation circuit 38 of the electronic circuit 30*a* can disconnect the driver circuit 36 of the electronic circuit 30*a* from the device 32*a*, and the isolation circuit of the electronic circuit 30*b* can connect the driver circuit of the electronic circuit 30*b* to the device 32*a*, so that the electronic circuit 30*b* can be used to operate the device 32*a*. Such a change could be performed automatically in response to the failure of the electronic circuit 30*a*, or in response to a command generated remotely or locally.

Thus, if either of the electronic circuits 30*a,b* fails, the electrical device 32*a,b* formerly operated by the failed electronic circuit can instead be operated by the still operational one of the electronic circuits. The failed one of the electronic circuits 30*a,b* is effectively isolated from its respective electrical device 32*a,b* in this situation.

In some situations, only a portion of an electronic circuit 30*a,b* may fail that prevents the respective one of the actuators 26*a,b* from being operated. For example, a motor driver circuit, a clutch driver circuit, etc., may fail, without resulting in an increase in current draw by the respective actuator 26*a,b*.

In those situations, a voltage greater than a normal operating voltage could be transmitted via a respective line 28*a,b* from the surface. This would trigger an isolation circuit 38 that is driven by a voltage. Upon triggering the isolation circuit 38 with the overvoltage, the electronic circuit 30*a* and actuator 26*a* would disconnect, similar to the previous example.

In some situations, portions of an electronic circuit 30*a,b* may be functioning, but the respective device 32*a,b* cannot be operated. In those situations, and others, a command could be sent from the surface to activate the associated isolation circuit 38, thereby isolating the electronic circuit 30*a,b*, in total or in part.

The isolation circuit 38 can comprise, in some examples, a switch type circuit for selectively connecting and disconnecting the driver circuit 36 and/or other portions of the associated electronic circuit 30*a,b* to its respective electrical device 32*a,b*. The isolation circuit 38 can be similar to a normally closed transistor(s), which is open when activated.

Figure 4:
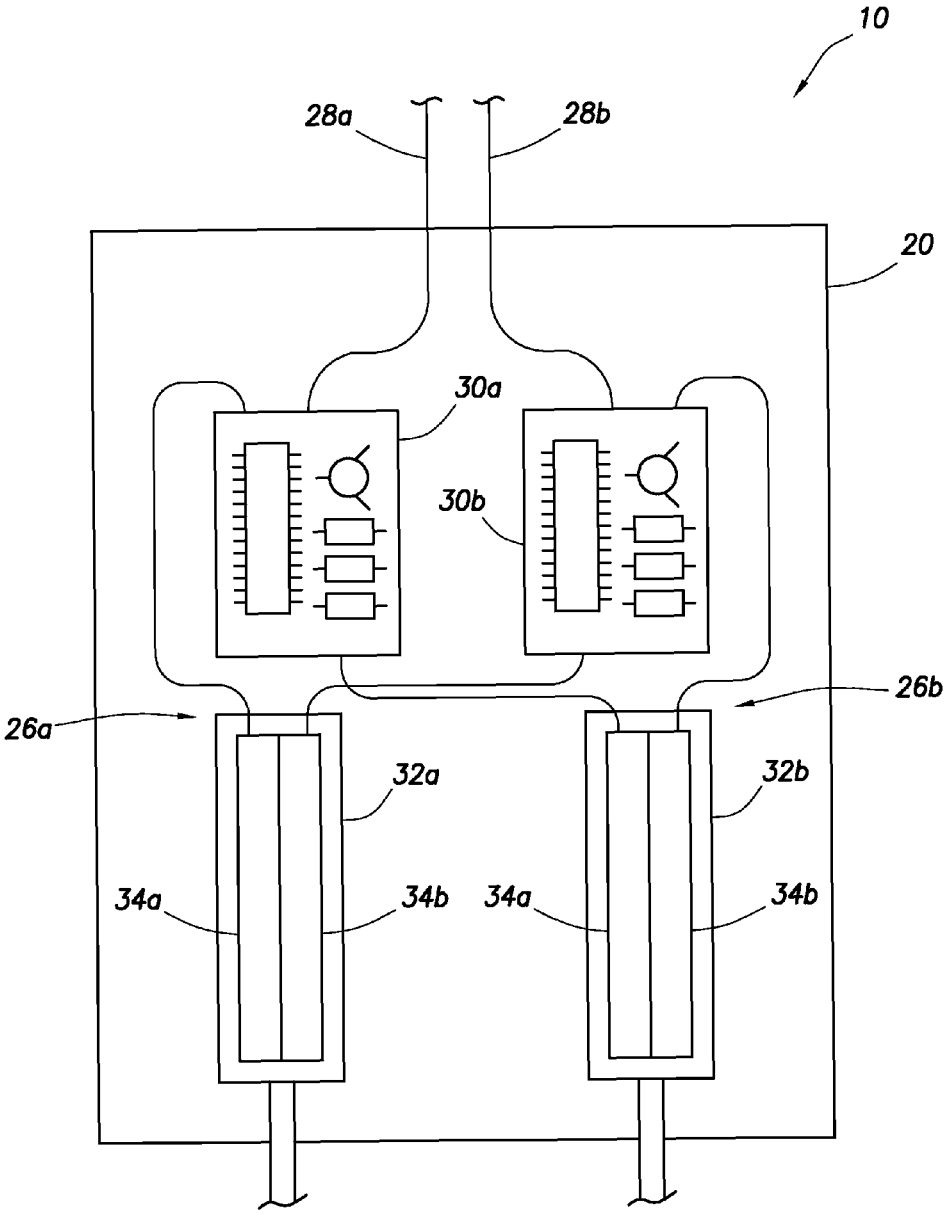
FIG. 4 is a representative schematic view of another example of the actuator section.

Referring additionally now to FIG. 4, another example of the actuator section 20 is representatively illustrated. In this example, each of the devices 32*a,b* includes multiple windings 34*a,b*. Each electronic circuit 30*a,b* can be used to control electrical power delivery to the respective windings 34*a,b* in both of the devices 32*a,b*.

In the event of a failure of either electronic circuit 30*a,b*, an isolation circuit 38 does not have to be activated, but power to the failed electronic circuit 30*a,b* should preferably be disconnected. If power to the failed circuit 30*a,b* is not turned off, the respective device 32*a,b* could have residual magnetism from current in the circuit 30*a,b* which may prevent the device from operating properly.

It may now be fully appreciated that significant advancements are provided to the art by the above disclosure. In examples described above, multiple well tool actuators 26*a,b* can be operated redundantly, even though an electronic circuit 30*a,b* or an electrical device 32*a,b* thereof fails.

A well tool 12 is provided to the art by the above disclosure, In one example, the well tool 12 can include at least first and second electrical devices 32*a,b*, at least first and second electronic circuits 30*a,b* which control operation of the respective first and second electrical devices 32*a,b*, the first and second electronic circuits 30*a,b* including at least respective first and second isolation circuits 38, wherein each of the first and second isolation circuits 38 isolates a corresponding one of the first and second electronic circuits 30*a,b* from a respective one of the first and second electrical devices 32*a,b* in response to a predetermined condition.

Each of the first and second isolation circuits 38 may connect the corresponding one of the first and second electronic circuits 30*a,b* to an opposite one of the first and second electrical devices 32*a,b* in response to the predetermined condition.

The predetermined condition can comprise current draw by the respective one of the first and second electrical devices 32*a,b* greater than a predetermined threshold, voltage across the respective one of the first and second electrical devices 32*a,b* greater than a predetermined threshold, a predetermined signal transmitted from a remote location (for example, via the lines 28), and/or a failure of the respective one of the first and second electrical devices 32*a,b*.

The first and second electrical devices 32*a,b* may comprise motor windings. The first and second electrical devices 32*a,b* may actuate the well tool 12 positioned in a subterranean well.

A method of operating a well tool 12 in a subterranean well is also described above. In one example, the method can comprise: providing first and second electronic circuits 30*a,b* for operation of respective first and second electrical devices 32*a,b* of the well tool 12; disconnecting the first electronic circuit 30*a* from the first electrical device 32*a* in the well; and connecting the second electronic circuit 30*b* to the first electrical device 32*a* in the well.

The method can include isolating the first electronic circuit 30*a* from the second electrical device 32*b*.

The method can include operating the second electrical device 32*b* with the second electronic circuit 30*b*.

The method can include operating the first and second electrical devices 32*a,b* with the second electronic circuit 30*b*.

The disconnecting step can be performed in response to a predetermined condition. The predetermined condition may comprise a failure of the first electronic circuit 30*a*.

Each of the first and second electrical devices 32*a,b* may comprise multiple motor windings 34*a,b*.

Another method of operating a well tool 12 in a subterranean well can comprise: providing first and second electronic circuits 30*a,b* for operation of respective first and second electrical devices 32*a,b* of the well tool 12; disconnecting the first electronic circuit 30*a* from the first electrical device 32*a* in the well; and connecting the first electronic circuit 30*a* to the second electrical device 32*b* in the well.

The method can include, prior to the connecting the first electronic circuit 30*a* to the second electrical device 32*b*: operating the second electrical device 32*b* with the second electronic circuit 30*b* and then disconnecting the second electronic circuit 30*b* from the second electrical device 32*b* in the well.

The step of connecting the first electronic circuit 30*a* to the second electrical device 32*b* can include connecting the first electronic circuit 30*a* to a first one of multiple motor windings 34*a,b* of the second electrical device 32*b*. The method can also include operating the second electrical device 32*b* with the second electronic circuit 30*b* connected to a second one of the multiple motor windings 34*a,b*.

The disconnecting step may be performed in response to a predetermined condition. The predetermined condition can comprise a failure of the first electrical device 32*a*, current draw by the first electrical device 32*a* greater than a predetermined threshold, voltage across the first electrical device 32*a* greater than a predetermined threshold, and/or a predetermined signal transmitted from a remote location.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool, comprising:

first and second electrical devices, wherein the first and second electrical devices are redundant actuators of the well tool; and first and second electronic circuits which can interchangeably control operation of the first and second electrical devices, the first and second electronic circuits including first and second isolation circuits, wherein the first and second isolation circuits selectively permit connection between the first electronic circuit and the first electrical device, the first electronic circuit and the second electrical device, the second electronic circuit and the first electrical device, and the second electronic circuit and the second electrical device.

2. The well tool of claim 1, wherein the first and second isolation circuits connect one of the first and second electronic circuits to one of the first and second electrical devices in response to a predetermined condition.

3. The well tool of claim 2, wherein the predetermined condition comprises current draw by one of the first and second electrical devices greater than a predetermined threshold.

4. The well tool of claim 2, wherein the predetermined condition comprises voltage across one of the first and second electrical devices greater than a predetermined threshold.

5. The well tool of claim 2, wherein the predetermined condition comprises a predetermined signal transmitted from a remote location.

6. The well tool of claim 2, wherein the predetermined condition comprises a failure of one of the first and second electrical devices.

7. The well tool of claim 1, wherein the first and second electrical devices comprise motor windings.

8. The well tool of claim 1, wherein the well tool is positioned in a subterranean well.

9. A method of operating a well tool in a subterranean well, the method comprising:

providing first and second electronic circuits for operation of first and second electrical devices, wherein the first and second electrical devices are redundant actuators of the well tool;

disconnecting the first electronic circuit from the first electrical device in the well; and connecting the second electronic circuit to the first electrical device in the well, and operating the first electrical device with the second electronic circuit.

10. The method of claim 9, further comprising isolating the first electronic circuit from the second electrical device.

11. The method of claim 9, further comprising operating the second electrical device with the second electronic circuit.

12. The method of claim 9, further comprising operating the first and second electrical devices with the second electronic circuit.

13. The method of claim 9, wherein the disconnecting is performed in response to a predetermined condition.

14. The method of claim 13, wherein the predetermined condition comprises a failure of the first electronic circuit.

15. The method of claim 9, wherein the first and second electrical devices comprise motor windings.

16. The method of claim 9, wherein each of the first and second electrical devices comprises multiple motor windings.

17. A method of operating a well tool in a subterranean well, the method comprising:

providing first and second electronic circuits for operation of first and second electrical devices, wherein the first and second electrical devices are redundant actuators of the well tool;

disconnecting the first electronic circuit from the first electrical device in the well; and connecting the first electronic circuit to the second electrical device in the well, and operating the second electrical device with the first electronic circuit.

18. The method of claim 17, further comprising, prior to the connecting the first electronic circuit to the second electrical device: operating the second electrical device with the second electronic circuit and then disconnecting the second electronic circuit from the second electrical device in the well.

19. The method of claim 17, wherein connecting the first electronic circuit to the second electrical device further comprises connecting the first electronic circuit to a first one of multiple motor windings of the second electrical device.

20. The method of claim 19, further comprising operating the second electrical device with the second electronic circuit connected to a second one of the multiple motor windings.

21. The method of claim 17, wherein the disconnecting is performed in response to a predetermined condition.

22. The method of claim 21, wherein the predetermined condition comprises a failure of the first electrical device.

23. The method of claim 21, wherein the predetermined condition comprises current draw by the first electrical device greater than a predetermined threshold.

24. The method of claim 21, wherein the predetermined condition comprises voltage across the first electrical device greater than a predetermined threshold.

25. The method of claim 21, wherein the predetermined condition comprises a predetermined signal transmitted from a remote location.

26. The method of claim 17, wherein the first and second electrical devices comprise motor windings.

27. The method of claim 17, wherein each of the first and second electrical devices comprises multiple motor windings.

* * * * *